US006110251A

United States Patent [19]

Jackson et al.

[11] Patent Number: 6,110,251

[45] Date of Patent: Aug. 29, 2000

[54] GAS FILTRATION MEDIA AND METHOD OF MAKING THE SAME

[75] Inventors: Fred Lee Jackson, Littleton, Colo.; Patrick Lowry Pittman, Brandon, Miss.

[73] Assignee: Johns Manville International, Inc., Denver, Colo.

[21] Appl. No.: 09/185,426

[22] Filed: Nov. 3, 1998

[51] Int. Cl.[7] ..... B03C 3/28

[52] U.S. Cl. ..... 55/527; 55/528; 55/DIG. 5; 55/DIG. 39; 264/210.3; 264/210.4; 264/169

[58] Field of Search ..... 55/527, 528, DIG. 5, 55/DIG. 39; 264/210.3, 210.4, 169

[56] References Cited

U.S. PATENT DOCUMENTS

| | | | |
|---|---|---|---|
| 4,290,987 | 9/1981 | Soehngen et al. | 264/210.4 |
| 4,604,203 | 8/1986 | Kyle | 55/527 |
| 5,401,446 | 3/1995 | Tsai et al. . | |
| 5,411,576 | 5/1995 | Jones et al. . | |
| 5,464,688 | 11/1995 | Timmons et al. . | |
| 5,496,507 | 3/1996 | Angadjivand et al. . | |
| 5,582,907 | 12/1996 | Pall . | |
| 5,645,057 | 7/1997 | Watt et al. . | |
| 5,645,627 | 7/1997 | Lifshutz et al. . | |
| 5,730,885 | 3/1998 | Blakeslee et al. | 264/169 |

*Primary Examiner*—David A. Simmons
*Assistant Examiner*—Minh-Chau T. Pham
*Attorney, Agent, or Firm*—John D. Lister

[57] ABSTRACT

An improved gas filtration media with a lower initial pressure drop and increased dirt holding capacity includes a fibrous mat of randomly oriented meltblown polymeric fibers made from a polymer with between 0.2% and 10.0% by weight of: a) a nucleating agent to increase the rate of crystallization of the polymer forming the fibers and improve the heat sealability of media made from the fibers and/or b) an electrostatic charging enhancer to reduce surface tension of the polymer and inter-fiber attraction, as the fibers are cooled during formation and collection the fibers, to thereby facilitate the formation of the fibrous mat with discrete fibers. Preferably, the polymer is polypropylene, the nucleating agent is bis-benzylidene sorbitol, and electrostatic charging enhancer is a fatty acid.

12 Claims, No Drawings

GAS FILTRATION MEDIA AND METHOD OF MAKING THE SAME

BACKGROUND OF THE INVENTION

The present invention relates to a gas filtration media and, in particular, to a gas filtration media, with reduced initial pressure drops and higher dust or dirt holding capacities. The polymeric fibers forming the filtration media are made from a polymer which includes a nucleating agent and/or an electrostatic charging enhancer. The nucleating agent and/or electrostatic charging enhancer present in the polymer facilitate(s) the formation and collection of discrete fibers during the fiberization process through the maintenance of fiber integrity.

Filtration media for filtering solid and liquid aerosol particles from gas streams, such as air streams are frequently made from mats of meltblown polymeric fibers. The polymeric fibers forming these mats typically have a mean diameter between 0.5 and 15 microns and when collected during the fiberization process, these fine diameter fibers tend to adhere, bond or otherwise at least partially meld into each other; lose their discrete nature; and form a less fibrous, more sheet-like material than would otherwise occur if the fibers maintained their integrity. This melding of the polymeric fibers into each other to reduce the fibrous nature of the mat being collected to form a filtration media increases the initial pressure drop across the filtration media and decreases the dust or dirt holding capacity of the filtration media formed from the mat. The increase in the initial pressure drop across the filtration media and the reduced dust or dirt holding capacity of the filtration media increase the operating costs for such filtration media and require more frequent replacement of the filtration media. Thus, there has been a need to provide mats of more discrete meltblown polymeric fibers to increase the resiliency and loft of the filtration media made from the mats and reduce the initial pressure drop across the filtration media while increasing the dust or dirt holding capacity of such filtration media.

SUMMARY OF THE INVENTION

The fibrous meltblown polymeric fiber mat and the method of making the fibrous meltblown polymeric fiber mat of the present invention, provide an improved gas filtration media with a lower initial pressure drop across the filtration media and an increased dust or dirt holding capacity. The fibrous meltblown polymeric fiber mat is formed of randomly oriented meltblown polymeric fibers. The polymeric fibers are made from a polymer with between 0.2% and 10.0% by weight of a nucleating agent to increase the rate of crystallization of the polymer forming the fibers and/or an electrostatic charging enhancer to the reduce surface tension of the polymer forming the fibers, as the polymer forming the fibers is cooled after fiberization and during collection of the fibers. By increasing the rate of crystallization and reducing surface tension of the polymer, the nucleating agent and electrostatic charging enhancer maintain fiber integrity to facilitate the formation of discrete fibers. When collected, these discrete fibers remain in their fibrous form, rather than melding into each other to form a more sheet-like material, and thereby form a more resilient mat with more loft, less initial pressure drop, and increased dust or dirt holding capacity. Preferably, the polymer used to form the meltblown polymeric fibers is polypropylene, the nucleating agent is bis-benzylidene sorbitol and electrostatic charging enhancer is a fatty acid amide.

DESCRIPTION OF THE PREFERRED EMBODIMENTS

The filtration media of the present invention for filtering air and other gases containing solid and aerosol particles is made from a mat of randomly oriented, meltblown polymeric fibers. Typically, the mat of meltblown polymeric fibers forming the filtration media is made by melting a polymeric material within a melter and extruding the molten polymeric material through a plurality of orifices to form continuous primary filaments. The continuous primary filaments exiting the orifices are introduced directly into a high velocity air stream which attenuates the filaments and forms discrete meltblown fibers from the continuous filaments. The meltblown fibers thus formed are cooled and collected, normally on a foraminous spun bond mat backing sheet, to form a mat of randomly oriented polymeric fibers having a basis weight ranging from about 5 grams/sq. meter to about 500 grams/sq. meter. During this fiberization process, the molten polymeric material forming the fibers is rapidly cooled from a temperature ranging from about 450° F. to about 500° F. to the ambient temperature of the collection zone, e.g. about 80° F. The meltblown fibers formed by this process typically have a mean diameter from about 0.5 to about 15 microns.

In the method of the present invention, the polymeric material used to form the polymeric fibers of the present invention includes one or two additives (a nucleating agent and/or an electrostatic charging enhancer) to facilitate the formation of discrete fibers which, when collected to form the mat, do not tend to meld together to form a less fibrous sheet-like material. The presence of the nucleating agent in the polymeric material forming the fibers of the present invention increases the rate of crystal initiation throughout the polymeric material thereby solidifying the fibers formed by the fiberization process of the present invention significantly faster than fibers formed from the polymeric material without the nucleating agent. The more rapid solidification of the polymeric material forming the fibers in the method of the present invention, due to the presence of the nucleating agent, reduces the tendency of the fibers to lose their discrete nature and meld together when collected and facilitates the retention of the fibers discrete nature when collected to form a resilient mat with high loft, a low initial pressure drop and an increased dust or dirt holding capacity. In addition, the presence of the nucleating agent in the composition forming the fibers has been found to enhance the heat sealing properties of a polypropylene media.

The presence of the electrostatic charging enhancer in the polymeric material forming the fibers of the present invention lowers the surface tension of the polymeric material of the fibers to a point where the fibers are less attracted to each other due to the surface tension and the fibers maintain their integrity and remain more discrete. Thus, the reduction of the surface tension of the polymeric material forming the fibers in the method of the present invention reduces the tendency of the fibers to lose their discrete nature and meld together when collected and facilitates the retention of fibers discrete nature when collected to form a more resilient mat with high loft, a lower initial pressure drop and an increased dust or dirt holding capacity.

The polymeric material forming the fibers of the present invention includes between 0.2% and 10% by weight of a nucleating agent and/or an electrostatic charging enhancer and preferably, between 1% and 3% by weight of a nucleating agent and/or an electrostatic charging enhancer. When both the nucleating agent and the electrostatic charging enhancer are present in the polymeric material, preferably, each additive is present in an amount at least equal to 0.5% by weight of the polymeric material.

The preferred polymeric material used in the method and the meltblown fibers of the present invention is polypropylene.

The preferred nucleating agent used in the polymeric material of the present invention is bis-benzylidene sorbitol. An example of a suitable, commercially available, bis-benylidene sorbitol is MILLAD 3988 bis-benylidene sorbitol from Milliken & Company of Spartanburg, S.C. Although the particle size of the following nucleating agents may be too great, especially when forming very fine diameter fibers, it is contemplated that the following additives might also be used as nucleating agents: sodium succinate; sodium glutarate; sodium caproate; sodium 4-methylvalerate; sodium p-tert-butylbenzoate; aluminum di-p-tert-butylbenzoate; potassium p-tert-butylbenzoate; sodium p-tert-butylphenoxyacetate; aluminumphenylacetate; sodium cinnamate; aluminum benzoate; sodium B-benzoate; potassium benzoate; aluminum tertbutylbenzoate; anthracene; sodium hexanecarboxylate; sodium heptanecarboxylate; sodium 1,2-cyclohexanedicarboxylate; sodium diphenylacetate; sodium 2,4,5-tricholorphenoxyacetate; sodium cis-4-cyclohexane 1,2-dicarboxylate; sodium 2,4-dimethoxybenzoate; 2-napthoic acid; napthalene-1,8-dicarboxylic acid; 2-napthyloxyacetic acid; and 2-napthylacetic acid.

The preferred electrostatic charging agent used in the polymeric material of the present invention are fatty acid amides such as [N(2 Hydroxy ethyl)-12 Hydroxystearamide] or [N,N' Ethlene Bis 12-Hydroxystearamide]. An example of a suitable, commercially available, [N(2 Hydroxy ethyl) -12 Hydroxystearamide] is PARICIN 220 fatty acid amide from CasChem, Inc. of Bayonne, N.J. An example of a suitable, commercially available, [N,N' Ethlene Bis 12-Hydroxystearamide] is PARICIN 285 from CasChem of Bayonne, N.J. Other additives which may be suitable as electrostatic charging enhancers are: anthracene; poly(4-methyl-1-pentene); hydroxybutanedioic acid; (Z) butenedioic acid: acetic acid and (E)-2-butenedioic acid.

The following tests were conducted with filtration media made with meltblown polypropylene fibers formed from polypropylene without any nucleating agent or electrostatic charging enhancer (Std. DPS-95) and filtration media made with meltblown polypropylene fibers formed from polypropylene including a nucleating agent or a nucleating agent and an electrostatic charging enhancer (DPS-95 with DBS or DBS and Fatty Acid Amide). The nucleating agent used (DBS) was bis-benzylidene sorbitol and the electrostatic charging agent used (Fatty Acid Amide) was [N,N'Ethlene Bis 12-Hydroxystearamide]. As shown in the following table, the addition of a nucleating agent or a nucleating agent and an electrostatic charging enhancer to the polypropylene forming the fibers of the filtration media greatly reduces the initial pressure drop across the filtration media (by 22% to 39%) and greatly increases the dust or dirt holding capacity of the filtration media (by 34% to 114%). The tests demonstrate that the formation of more discrete fibers and their inclusion into a mat of randomly oriented fibers forming the filtration media to create a product with added loft, functions to both significantly reduce the initial pressure drop across the filtration media and significantly increase the dust or dirt holding capacity of the filtration media. In addition, as mentioned above, the presence of the nucleating agent in the composition forming the fibers has been found to improve the heat sealing properties of polypropylene media.

| CAPACITY FILTER MEDIA | INITIAL EFFICIENCY PERCENT | INITIAL PRESSURE INCHES OF WATER | DUST Gms/4 sq. ft. |
|---|---|---|---|
| Std. DPS-95 | 65 | 0.23 | 7.0 |
| DPS-95 With 1% DBS | 61 | 0.18 | 9.4 |
| DPS-95 With 1% DBS & 1% Fatty Acid Amide | 62 | 0.17 | 15.0 |
| DPS-95 With 2% DBS | 54 | 0.18 | 12.8 |
| DPS-95 With 1% DBS & 2% Fatty Acid Amide | 63 | 0.14 | 10.0 |

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A gas filtration media comprising:

a fibrous mat of randomly oriented meltblown polymeric fibers; the fibers comprising a polymer which includes between 0.5% and 9.5% by weight nucleating agent to increase the rate of crystallization of the polymer forming the fibers as the polymer is cooled during formation and collection of the fibers and between 0.5% and 9.5% electrostatic charging enhancer to lower surface tension of the polymer and inter-fiber attraction as the polymer is cooled during formation and collection of the fibers to thereby facilitate the formation of the fibrous mat with more discrete fibers, a high loft and enhanced heat sealability.

2. The gas filtration media according to claim 1, wherein: the polymer is polypropylene and the nucleating agent is selected from a group consisting of bis-benzylidene sorbitol; sodium succinate; sodium glutarate; sodium caproate; sodium 4-methylvalerate; sodium p-tert-butylbenzoate; aluminum di-p-tert-butylbenzoate; potassium p-tert-butylbenzoate; sodium p-tert-butylphenoxyacetate; aluminum phenylacetate; sodium cinnamate; aluminum benzoate; sodium B-benzoate; potassium benzoate; aluminum tertbutylbenzoate; anthracene; sodium hexanecarboxylate; sodium heptanecarboxylate; sodium 1,2-cyclohexanedicarboxylate; sodium diphenylacetate; sodium 2,4,5-tricholorphenoxyacetate; sodium cis-4-cyclohexane 1,2-dicarboxylate; sodium 2,4-dimethoxybenzoate; 2-napthoic acid; napthalene-1,8-dicarboxylic acid; 2-napthyloxyacetic acid; and 2-napthylacetic acid.

3. The gas filtration media according to claim 1, wherein: the polymer is polypropylene; the polypropylene includes between 1.0% and 3.0% by weight of the nucleating agent; and the nucleating agent is bis-benzylidene sorbitol.

4. The gas filtration media according to claim 1, wherein: the electrostatic charging enhancer is selected from a group consisting of a fatty acid amide; anthracene; poly(4-methyl-1-pentene); hydroxybutanedioic acid; (Z) butenedioic acid: acetic acid and (E)-2-butenedioic acid.

5. The gas filtration media according to claim 1, wherein: the electrostatic charging enhancer is a fatty acid amide.

6. The gas filtration media according to claim 1, wherein: the polymer is polypropylene; the nucleating agent and the electrostatic charging enhancer comprise between 1.0% and 3.0% of the polypropylene; and the nucleating agent is bis-benzylidene sorbitol and the electrostatic charging enhancer is a fatty acid amide.

7. A method of making a gas filtration media comprising:

using a polymer to form fibers which includes between 0.5% and 9.5% by weight nucleating agent to increase the rate of crystallization of the polymer as the polymer is cooled during formation and collection of the fibers and between 0.5% and 9.5% electrostatic charring enhancer to lower surface tension of the polymer and inter-fiber attraction as the polymer is cooled during formation and collection of the fibers to thereby maintain fiber integrity and facilitate the formation and collection of the fibers as discrete fibers;

fiberizing the polymer; and collecting the fibers to form a fibrous mat of randomly oriented polymeric fibers.

8. The method of making a gas filtration media according to claim 7, wherein: the polymer is polypropylene and the nucleating agent is selected from a group consisting of bis-benzylidene sorbitol; sodium succinate; sodium glutarate; sodium caproate; sodium 4-methylvalerate; sodium p-tert-butylbenzoate; aluminum di-p-tert-butylbenzoate; potassium p-tert-butylbenzoate; sodium p-tert-butylphenoxyacetate; aluminum phenylacetate; sodium cinnamate; aluminum benzoate; sodium B-benzoate; potassium benzoate; aluminum tertbutylbenzoate; anthracene; sodium hexanecarboxylate; sodium heptanecarboxylate; sodium 1,2-cyclohexanedicarboxylate; sodium diphenylacetate; sodium 2,4,5-tricholorphenoxyacetate; sodium cis-4-cyclohexane 1,2-dicarboxylate; sodium 2,4-dimethoxybenzoate; 2-napthoic acid; napthalene-1,8-dicarboxylic acid; 2-napthyloxyacetic acid; and 2-napthylacetic acid.

9. The method of making a gas filtration media according to claim 7, wherein: the polymer is polypropylene; the polypropylene includes between 1.0% and 3.0% nucleating agent by weight; and the nucleating agent is bis-benzylidene sorbitol.

10. The method of making a gas filtration media according to claim 9, wherein: the electrostatic charging enhancer is selected from a group consisting of a fatty acid amide; anthracene; poly(4-methyl-1-pentene); hydroxybutanedioic acid; (Z) butenedioic acid: acetic acid and (E)-2-butenedioic acid.

11. The method of making a gas filtration media according to claim 7, wherein: the electrostatic charging enhancer is a fatty acid amide.

12. The method of making a gas filtration media according to claim 7, wherein: the polymer is polypropylene; the nucleating agent and the electrostatic charging enhancer comprise between 1.0% and 3.0% of the polypropylene; and the nucleating agent is bis-benzylidene sorbitol and the electrostatic charging enhancer is a fatty acid amide.

* * * * *